US011136660B2

(12) United States Patent
Riddle et al.

(10) Patent No.: US 11,136,660 B2
(45) Date of Patent: Oct. 5, 2021

(54) METHODS FOR CREATING A ZINC-METAL OXIDE LAYER IN METAL COMPONENTS FOR CORROSION RESISTANCE

(71) Applicant: Electric Power Research Institute, Inc., Palo Alto, CA (US)

(72) Inventors: John Morrison Riddle, Forest, VA (US); Carola Annemarie Gregorich, Castro Valley, CA (US); Daniel M. Wells, Charlotte, NC (US)

(73) Assignee: Electric Power Research Institute, Inc., Palo Alto, CA (US)

( * ) Notice: Subject to any disclaimer, the term of this patent is extended or adjusted under 35 U.S.C. 154(b) by 316 days.

(21) Appl. No.: 15/336,604

(22) Filed: Oct. 27, 2016

(65) Prior Publication Data

US 2017/0121809 A1 May 4, 2017

Related U.S. Application Data

(60) Provisional application No. 62/247,945, filed on Oct. 29, 2015.

(51) Int. Cl.
*C23C 10/00* (2006.01)
*C23C 8/10* (2006.01)
(Continued)

(52) U.S. Cl.
CPC ..... *C23C 10/08* (2013.01); *B21B 21/00* (2013.01); *B21C 1/22* (2013.01); *C21D 6/004* (2013.01); *C21D 9/0068* (2013.01); *C21D 9/08* (2013.01); *C23C 8/02* (2013.01); *C23C 8/14* (2013.01); *C23C 10/14* (2013.01); *C23C 10/36* (2013.01); *C23C 10/52* (2013.01); *C23C 10/54* (2013.01); *C23C 10/60* (2013.01); *B21C 1/003* (2013.01)

(58) Field of Classification Search
CPC ..... C23C 22/53; C23C 8/10–18
See application file for complete search history.

(56) References Cited

U.S. PATENT DOCUMENTS 5,242,572 A 9/1993 Shindou
5,277,228 A 1/1994 Yamanashi
(Continued)

FOREIGN PATENT DOCUMENTS

EP 1 439 240 A1 7/2004
EP 2 228 149 A1 9/2010
(Continued)

*Primary Examiner* — Lois L Zheng
(74) *Attorney, Agent, or Firm* — Owens Law Firm, PC

(57) ABSTRACT

The present invention provides a method for manufacturing a finished metal object or product having a corrosion resistant layer integral to or within a top portion of at least one of its surfaces that would be exposed to a corrosive environment. In one embodiment, the method for manufacturing is directed to a finished metal tubing product having a corrosion resistant layer within its inside surface that is exposed to a fluid and wherein the corrosion resistant layer is a zinc-metal oxide layer, such as a zinc-chromium oxide layer, or a zinc-mixed metal oxide layer. In addition to
(Continued)

methods of manufacturing, the present invention provides finished metal objects or products having a corrosion resistant layer integral to or within a top portion of at least one surfaces that would be exposed to a corrosive environment.

21 Claims, 3 Drawing Sheets

(51) Int. Cl.

| | |
|---|---|
| ***C23C 10/08*** | (2006.01) |
| ***C23C 10/14*** | (2006.01) |
| ***C23C 10/36*** | (2006.01) |
| ***C23C 10/52*** | (2006.01) |
| ***C23C 10/54*** | (2006.01) |
| ***C23C 8/14*** | (2006.01) |
| ***C23C 8/02*** | (2006.01) |
| ***B21B 21/00*** | (2006.01) |
| ***B21C 1/22*** | (2006.01) |
| ***C21D 6/00*** | (2006.01) |
| ***C21D 9/00*** | (2006.01) |
| ***C21D 9/08*** | (2006.01) |
| ***C23C 10/60*** | (2006.01) |
| *C23C 22/53* | (2006.01) |
| *B21C 1/00* | (2006.01) |

(56) References Cited

U.S. PATENT DOCUMENTS

| | | | | |
|---|---|---|---|---|
| 5,779,878 | A * | 7/1998 | Morgan | C25F 5/00 205/657 |
| 7,314,671 | B1 * | 1/2008 | Preikschat | C23C 22/34 428/472.1 |
| 2004/0166360 | A1 | 8/2004 | Imai | |
| 2011/0226387 | A1 | 9/2011 | Yoichi et al. | |
| 2013/0042660 | A1 | 2/2013 | Baensch | |
| 2013/0323532 | A1 | 12/2013 | Sagawa et al. | |
| 2014/0141275 | A1 | 5/2014 | Ramirez | |
| 2015/0314569 | A1 * | 11/2015 | Lin | C22C 27/06 428/627 |

FOREIGN PATENT DOCUMENTS

| | | | | |
|---|---|---|---|---|
| EP | 2 520 693 | A1 | 11/2012 | |
| JP | 2000-352597 | A | 12/2000 | |
| SU | 905322 | * | 2/1982 | C23C 10/52 |

* cited by examiner

METHODS FOR CREATING A ZINC-METAL OXIDE LAYER IN METAL COMPONENTS FOR CORROSION RESISTANCE

CROSS REFERENCE TO RELATED APPLICATIONS

This application claims the benefit of U.S. Provisional Application No. 62/247,945, filed Oct. 29, 2015, the content of which is incorporated by reference herein in its entirety.

BACKGROUND OF THE INVENTION

Field of the Invention

The present invention in its various embodiments provides a method for manufacturing a corrosion resistant layer integral to a top portion of a metal surface of a metal object or product to reduce corrosion of the metal surface and release of metal species. In particular, the present invention provides a method for manufacturing a finished metal object or product having a stabilized zinc-metal oxide or zinc-mixed metal oxide layer integral to an exposed surface, such as the interior surface of a metal tube, to reduce corrosion and release of metals from the metal. The present invention in its various embodiments also provides finished metal objects or products having an integral corrosion resistant layer.

Description of Related Art

In the power generating industry, metal corrosion in water cooled systems is a major reliability factor. Water-borne corrosion is driven by metal release from a metal surface, which is controlled by metal species solubility under given conditions. Any metal, steel, or alloy is subject to such corrosion. The released material is often deposited elsewhere in the system, such as in low-flow regions or on heat transfer surfaces, causing fouling and efficiency losses. In the nuclear industry in particular, metallic releases are a source for generating radiation fields external to the reactor vessel.

Numerous technologies to reduce metal corrosion and release of metals by protecting metal surfaces from corrosion have been developed. For example, in nuclear power applications, an in-situ treatment is used to "precondition" metal surfaces during the hot functional testing (HFT) period. In new pressurized water reactors (PWRs), steam generator tubing is treated with a given chemistry for a given period of time to precondition the inner surface of the tubing. In boiling water reactors (BWRs), feedwater tubing and other metal surfaces (e.g., feedwater heaters) that transport or would be exposed to reactor coolant water during normal operation may also be preconditioned. The expectation of such "preconditioning" is to provide stable corrosion films on the metal surfaces that would limit subsequent corrosion and metal release during operation, thereby reducing incorporation of radioactive species in the reactor water during plant operation. Unfortunately, such preconditioning does not provide a stable, long-lasting corrosion resistant film that avoids metal release during normal operation. Additionally, plants have only a limited amount of time available for such preconditioning and cannot devote thousands of exposure hours that may otherwise be necessary to establish a stable film on most metal surfaces.

Accordingly, there is a need for a more stable corrosion resistant layer for exposed metal surfaces, in particular, those used in a PWR or BWR environment. In particular, there is a need for a manufacturing process to make metal products with a more stable corrosion resistant layer integral to a top portion of an exposed surface of the metal product, such as a zinc-metal oxide layer that resists corrosion and the corresponding release of metals.

BRIEF SUMMARY OF THE INVENTION

The present invention provides a method for manufacturing a finished metal object or product having a corrosion resistant layer within a top portion of at least one of its surfaces that would be exposed in use to at least a potentially corrosive or corrosive environment. Therefore, it should be appreciated that the corrosion resistant oxide layer is formed during the manufacturing process used to make the finished metal object or product, as opposed to creating a protective layer after manufacturing, e.g., by creating a protective layer in-situ (i.e., wherein the finished metal object or product has been completely manufactured and is ready for its intended use, has been put in place for such use, and thereafter, but prior to use, the protective layer is created). In one embodiment, the corrosion resistant layer is a zinc-metal oxide layer in which zinc has been incorporated into and bonds with a metal within the metal object or product to form a zinc-metal oxide layer. In one embodiment, the zinc-metal oxide layer is a zinc-chromium oxide layer. In another embodiment, the corrosion resistant layer is a zinc-mixed metal oxide layer in which zinc has been incorporated into and bonds to more than one metal within the metal object or product to form a zinc-mixed metal oxide layer. It should be appreciated that the zinc-metal oxide layer and the zinc-mixed metal oxide layer are more stable than a similar layer that has been manufactured in-situ.

In one embodiment, the present invention provides a method for creating a finished metal product having a corrosion resistant oxide layer, comprising incorporating zinc into at least one surface of a semi-finished metal product that will be exposed during use of a finished metal product produced from the semi-finished metal product, wherein the semi-finished metal product comprises a metal; forming the semi-finished metal product into a predetermined shape of the finished metal product after the incorporation of zinc; and heat-treating the semi-finished metal product in a controlled environment after the forming to form a zinc-metal oxide layer within a top portion of the at least one surface. In one embodiment, the semi-finished metal product comprises a metal that is chromium and the zinc-metal oxide formed is a zinc-chromium oxide layer. In one embodiment, the controlled environment includes the presence of hydrogen and oxygen.

In another embodiment, the present invention provides a method for creating a metal tube having a corrosion resistant oxide layer within a portion of the exposed inner surface of the metal tube, comprising incorporating zinc into at least one surface of a semi-finished metal product comprising a metal; forming a metal tube from the semi-finished metal product, wherein the at least one surface is an inner surface of the metal tube; heat-treating the metal tube in a controlled environment after the forming to form a zinc-metal oxide layer within a top portion of the inner surface of the metal tube. In an additional embodiment, the metal tube is further processed after the heat-treating by pilgering or using a cold drawing process. In another embodiment, the zinc is incorporated into a metal tube that has already been formed, followed by heat treating and optional further processing after the heat-treating by pilgering or using a cold drawing process. In one embodiment, the semi-finished metal product comprises a metal that is chromium and the zinc-metal oxide formed is a zinc-chromium oxide layer. In one embodiment, the controlled environment includes the presence of hydrogen and oxygen.

In another embodiment, the present invention provides a metal product having a corrosion resistant surface, comprising a finished metal product, ready for use without further processing of the metal, having a corrosion resistant layer within at least one surface of said finished metal product, wherein said corrosion resistant layer is produced by the processes described herein. For example, in one embodiment, the process includes incorporating zinc into at least one surface of a semi-finished metal product that will be exposed during use of the finished metal product produced from the semi-finished metal product, wherein the semi-finished metal product comprises a metal; forming the semi-finished metal product into a predetermined shape of the finished metal product after the incorporation of zinc; and heat-treating the semi-finished metal product in a controlled environment after the forming to form a zinc-metal oxide layer within a top portion of the at least one surface. In one embodiment, the semi-finished metal product comprises a metal that is chromium and the zinc-metal oxide formed is a zinc-chromium oxide layer. In one embodiment, the controlled environment includes the presence of hydrogen and oxygen. In an additional embodiment, the metal product comprises a tube and wherein the corrosion resistant layer is within an inner surface of the tube and wherein the tube and corrosion resistant layer have been made by the processes described herein.

It should be appreciated that the present invention provides a stable corrosion resistant layer, formed during the manufacturing process of a given finished metal object or product, that is more stable and has more long-term viability than a corrosion resistant layer formed in-situ of after completion of manufacture of the finished metal object or product and it has been readied for service or use, for example, by being put in place and connected for service (e.g., a finished metal tube being connected in a process in which it will be used). Accordingly, the present invention provides this more stable corrosion resistant layer by incorporating zinc into the top or upper portion of a given surface of a semi-finished metal object or product (i.e., prior to the last component manufacturing steps) to ensure that a subsequent and final heat treatment used in the manufacturing process creates zinc-metal oxide or zinc-mixed metal oxide layer and stabilized surface structure prior to use. As a result, corrosion of the underlying metal can be reduced, which may significantly increase asset reliability and plant availability and efficiency. Such also reduces the effects of the release of any metals that would otherwise occur as a result of such corrosion. In a nuclear power application, where the finished metal object or product may include a tube used as steam generator tubing associated with a pressurized water reactor (PWR) or feedwater tubing or other metal surfaces (e.g., feedwater heaters) that would be exposed to reactor coolant water from a boiling water reactor (BWR), reducing the release of metals into the fluid can reduce radiation fields that otherwise may be generated elsewhere in these systems.

Accordingly, it should be appreciated that in some embodiments the result of the present invention provides a component surface that does not require any lengthy preconditioning period to ensure minimal corrosion and metal release, such as what is done in-situ. The present invention is widely applicable to coolant circuit component manufacturing for power plants of any chromium-containing steel or any alloy, including alloys without chromium, in particular for steam generators, heat exchangers, and moisture separators. However, it may also be employed for piping and other related components. While the emphasis is on new component manufacturing, the principles are applicable to chemically and/or physically cleaned component surfaces that are already in service, in an effort to extend life-times and reduce metal releases upon placing back into service.

Benefits of installing components manufactured using this process include reduced corrosion resulting in improved component performance, reliability, and lifetime; lower metal releases resulting in improved plant heath, less fouling, reduced activation, improved core performance, and fuel reliability in nuclear plants; and lower metal releases, in particular of nickel from high-nickel alloys and cobalt from steels or any other alloys, that significantly reduce the ex-core radiation fields in nuclear plants thereby lowering the collected radiation exposures (CRE) to plant personnel.

DETAILED DESCRIPTION OF THE INVENTION

Figure 1:
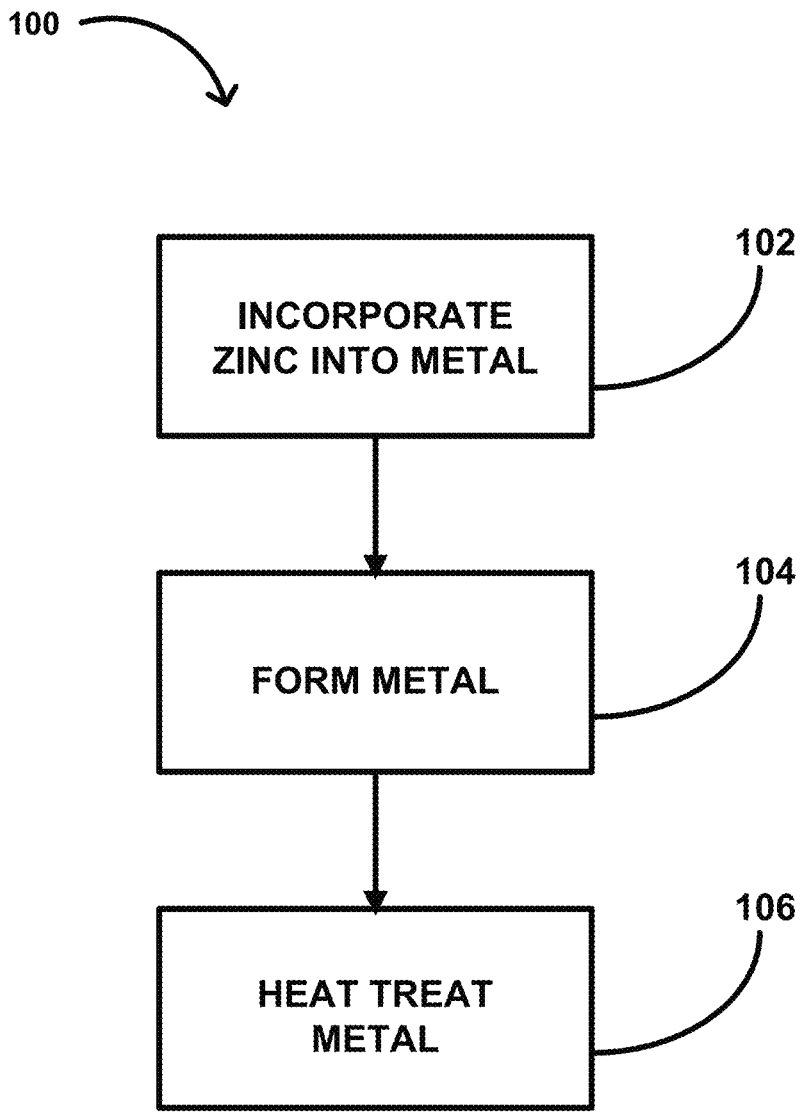
FIG. 1 illustrates a method for manufacturing a metal product having a corrosion resistant layer according to one embodiment of the present invention.

The present invention is described below with reference to the accompanying Figures. While the invention will be described in conjunction with particular embodiments, it should be understood that the invention includes different embodiments and can be applied to a wide variety of applications. Accordingly, the following description is exemplary and is intended to cover alternatives, modifications, and equivalents within the spirit and scope of the invention. Further, the various embodiments may be described by use of the terms "preferably," "for example," or "in one embodiment," but this characterization should not be viewed as limiting or as setting forth the only embodiments of the invention, as the invention encompasses other embodiments that may not be specifically recited in this description. Further, the use of the terms "invention," "present invention," "embodiment," and similar terms throughout this description are used broadly and are not intended to mean that the invention requires, or is limited to, any particular aspect being described in connection with one embodiment or that such description is the only manner in which the invention may be made or used.

In general, the present invention is directed to a method for manufacturing a finished metal object or product having a corrosion resistant layer within a top portion of an exposed surface of the metal object or product. In other words, the corrosion resistant layer is integral to the metal object or product and extends from the surface of the metal object or product into the interior of the metal object or product. Therefore, the corrosion resistant layer is the integral top portion of the metal having a given depth and where the surface is a surface that is exposed or to be exposed to a potentially corrosive or corrosive environment. Accordingly, the composition of this top portion of the metal is different from the initial composition of this portion of the metal object, as it now has the composition of the corrosion resistant layer.

It should be appreciated that the metal object or product that is manufactured to have the corrosion resistant layer may be composed of any metal or alloy. For example, Inconel, Incoloy, stainless steel, chrom-moly steel, low alloy steel, Stellite/Haynes alloys, Hasteloys, and Ultimet may be used. In some embodiments, the metal or alloy contains chromium. In other embodiments, the metal or alloy contains relatively low levels of chromium or no chromium.

The corrosion resistant layer would be formed within a portion of the given metal or alloy such that a surface of the corrosion resistant layer would be the surface that would be exposed to a corrosive environment. It should be appreciated that it may not be necessary for the corrosion resistant layer to extend laterally along the entirety of the given surface of the metal object or product. In some embodiments, however, the corrosion resistant layer will be formed such that its surface is co-extensive with the entirety of that particular surface of the metal object or product. In other embodiments, the surface of the corrosion resistant layer may only extend laterally such that one portion of a given metal surface of the metal object or product does not have a corrosion resistant layer while another portion of that same surface of the metal object or product does contain a corrosion resistant layer.

In one embodiment, the present invention is directed to manufacturing a finished metal object or product having a corrosion resistant layer composed of zinc-metal oxide or zinc-mixed metal oxide that is stable enough to provide long-term resistance during use of the finished metal object or product or during exposure to a corrosive environment of fluid. In one embodiment, the present invention is used to create a corrosion resistant layer composed of a stable zinc-metal oxide layer or zinc-mixed metal oxide layer within at least one surface of a finished metal object or product. It should be appreciated that the zinc-metal oxide layer includes zinc bonded to a single metal inherently present in the metal, such as chromium. It should be appreciated that the zinc-mixed metal oxide layer includes zinc bonded to more than one metal inherently present in the metal. In one embodiment, the present invention is used to create a stable zinc-chromium oxide layer within a surface of a finished metal object or product that is, for example, a nickel-iron-chromium bearing steel or any alloy containing chromium. It should be appreciated that in some embodiments, there may be an insufficient amount of chromium present to create a stable zinc-chromium oxide layer. In such cases, additional chromium may be added as described below to allow for creation of a stable zinc-chromium oxide layer.

It should be appreciated that in some embodiments, other metals may be added along with the metal used to create the corrosion resistant layer. For example, in one embodiment in which zinc is used to create the corrosion resistant layer, another metal, such as chromium, may be incorporated into the metal object or product in combination with the zinc. In this embodiment, the chromium is being added to the metal object or product or infused along with the zinc, even though there may be chromium inherently present in the metal object before such addition or in cases where the metal object or product does not contain chromium. In this manner, a metal object or product may be enhanced by adding metals, in addition to the metal being added to create the corrosion resistant layer, for example, in those cases in which the metal object or product is deemed to have a deficiency of a given metal species. Therefore, the addition of such metals in combination with the metal used to create the corrosion resistant layer can be used to ensure a desired composition of the top layer of the metal object or product. It should be appreciated that more than one metal can be added along with the metal used to create the corrosion resistant layer. In some embodiments, additional metals that may be incorporated include aluminum, molybdenum, titanium, zirconium, platinum, and mixtures of the foregoing.

More particularly, it should be appreciated that a better corrosion resistant layer may be formed by incorporating or adding an additional metal or metals along with the metal used to in combination form the corrosion resistant layer. By adjusting the composition of the top layer of the metal object or product to provide a composition that, in combination with the incorporation of a metal specifically used to form the corrosion resistant layer, yields a more desirable composition for the corrosion resistant layer itself. For example, in cases where the metal object or product either lacks chromium or has a relatively low concentration of chromium, the incorporation or addition of chromium along with the metal specifically incorporated or added to form the corrosion resistant layer, such as zinc, acts to increase the concentration of chromium and produce the desired zinc-chromium oxide formation that provides a better corrosion resistant layer compared to the absence of chromium. In some embodiments, additional metals that may be incorporated include aluminum, molybdenum, titanium, zirconium, platinum, and mixtures of the foregoing.

In one embodiment, the present invention is directed to a method of manufacturing a metal tube having a corrosion resistant layer within a top portion of its inside surface through which a corrosive fluid would flow during use of the metal tube. Such a metal tube may be used, for example, as steam generator tubing associated with a pressurized water reactor (PWR) or feedwater tubing and other metal surfaces (e.g., feedwater heaters) that transport or would be exposed to reactor coolant water from a boiling water reactor (BWR).

The present invention is also generally directed to a variety of finished metal objects or products having a corrosion resistant layer that has been created during the manufacturing process, as opposed to a corrosion resistant layer created or deposited on the metal surface after manufacture of the finished metal object or product has been completed. As described above, the corrosion resistant layer is formed within an upper portion of the given metal or alloy or within the surface of the given metal or alloy such that the surface of the corrosion resistant layer would be the surface that would be exposed to a corrosive environment. Again, it should be appreciated that the metal object or product that is manufactured to have the corrosion resistant layer may be composed of any metal or alloy.

As noted above, in one embodiment, the finished metal object or product may be a metal tube or tubing that carries a corrosive fluid. For example, the metal tubing may be used as steam generator tubing associated with a PWR or feedwater tubing and other metal surfaces that would be exposed to reactor coolant water from a BWR. The use of such tubing in a nuclear power environment is particularly important because, in addition to the damage to the tubing itself, any corrosion of the tubing leads to metals being released from the tubing into the fluid and often being deposited elsewhere in the system, such as in low-flow regions or on heat transfer surfaces causing fouling and efficiency losses. In the nuclear power industry in particular, these metallic releases may be sources for generating radiation fields external to the nuclear reactor vessel, which is otherwise to be avoided.

In one embodiment, the present invention is used to create and includes a finished metal object or product that has a zinc-metal oxide layer or zinc-mixed metal oxide layer within a surface of the finished metal object or product that will be exposed to a potentially corrosive or corrosive environment or fluid. In one embodiment, the present invention is used to create a finished metal object or product from a nickel-iron-chromium bearing steel or any alloy containing chromium that has a stable zinc-chromium oxide layer within a surface of the finished metal object or product that will be exposed to a potentially corrosive or corrosive environment or fluid. In one embodiment, the present invention is used to create a finished metal object or product made from any metal or alloy, including metals or alloys that do not contain any chromium or that have insufficient amounts of chromium needed to form a stable zinc-chromium oxide or sufficient corrosion resistant layer, that has a stable zinc-chromium oxide layer within a surface of the finished metal object or product that will be exposed to a potentially corrosive or corrosive environment or fluid.

Following, various embodiments of the methods and products of the present invention are described in connection with the Figures. It should be appreciated that use of the term "metal" is intended to be generic such that it includes any metal or alloy. Further, it should be appreciated that the use of the term "semi-finished metal product" refers to any metal object that still requires further processing before being a finished metal object or product that is ready for use, or for which there is still one or more steps or processes that must be completed, such as annealing, before becoming a finished metal object or product that is ready for use or sale. For example, a semi-finished metal product includes products produced from hot metal or the products that have been casted from the hot metal or molten steel, including ingots, blooms, billets, slabs, rods, and tube rounds. Once these semi-finished metal products are further processed, for example, by annealing or other steps typically taken in metal manufacturing as known to one of skill in the art, they would become finished metal products. Accordingly, a "finished" metal object or product is one for which no further processing steps in the standard metal manufacturing process are required and the metal object or product is ready for use in a manner for which it is ultimately intended.

It should also be appreciated that the corrosive resistant layer created by the process of the present invention is not a physically separate layer, such as a cladding that is attached to the surface of the metal object or product or an additional, separate coating applied on top of the existing surface of the metal object or product. Rather, as described above, the corrosion resistant layer is created within a top portion of the metal body of the object or product itself such that the corrosion resistant layer extends from the surface into the interior of the metal object or product. The depth of the corrosion resistant layer may vary depending upon the composition of the metal object or product and the metal used to form the corrosion resistant layer, whether any additional metals are being added, and the conditions under which the corrosion resistant layer is formed. Accordingly, the composition of this layer will be different than that of the underlying portion of the metal that exists below the corrosive resistant layer, the latter composition being that of the starting metal or alloy itself or that of the semi-finished metal product. For example, the corrosion resistant layer may be created by incorporation of zinc into the metal followed by oxidation to create a zinc-metal oxide layer or zinc-mixed metal oxide layer inherent in the upper portion of the metal object and, as noted, extending from the exposed outer surface of the metal to a given depth within the metal.

It should also be appreciated that the composition of the corrosion resistant layer will change with depth in the metal itself. Using zinc as an example, the amount of zinc that diffuses into the metal will affect that overall depth or thickness of the corrosion resistant layer. Further, the concentration of zinc within the corrosion resistant layer or within the top portion of the metal itself will likely change as a function of depth within the metal. Therefore, the overall composition of the corrosion resistant layer may itself change with depth within the metal itself, and the depth of the corrosion resistant layer will be different depending upon, for example, the different methods and conditions used to create the corrosion resistant layer during manufacturing (e.g., type of method used to contact the metal with zinc and the operating conditions for such method, such as temperature during contact, the composition of the base metal or alloy used, etc.). However, in one embodiment, the depth or thickness of the corrosion resistant layer can be defined as that depth within the metal for which the composition is different from the underlying composition of the metal itself prior to creation of the corrosion resistant layer or the composition of the semi-finished metal product. In one embodiment, the depth or thickness of the corrosion resistant layer can be defined as that depth within the metal having a composition that includes zinc, where zinc has been used to form the corrosion resistant layer and the initial composition of the metal object did not contain zinc. In one embodiment, the depth or thickness of the corrosion resistant layer can be defined as that depth within the metal having a composition that includes zinc-metal (e.g., zinc-chromium) or zinc-mixed metal oxide.

FIG. 1 illustrates a method for manufacturing a metal product having a corrosion resistant layer according to one embodiment of the present invention. In this process 100, in a first step 102, zinc is incorporated into at least one surface of a semi-finished metal object or product. Depending upon the specific process used to diffuse zinc into the surface of the metal, zinc may be incorporated into one or more surfaces exposed to the zinc. For example, zinc may be incorporated into any surface of a semi-finished metal object or product, including large metal components as well as tubing used in heat exchangers. At a minimum, however, the zinc is incorporated into a predetermined metal surface that will, during use of the finished metal object or product, be exposed to a corrosion, or potentially corrosive, environment. It should be appreciated that the process of the present invention may be applied to any semi-finished metal object or product. In one embodiment, the semi-finished metal object or product is a nickel-iron-chromium bearing steels or any alloy, including, for example, any alloy containing chromium. In some embodiments, the semi-finished metal object or product is composed of any metal or alloy, including metals or alloys that do not contain any chromium or that have insufficient amounts of chromium needed to form a stable zinc-chromium oxide or sufficient corrosion resistant layer.

The process for incorporating zinc into the metal surface may be performed using any process for incorporating metal atoms or compounds into a metal surface known in the art. For example, diffusing pack diffusion, pack cementation, chemical deposition, or vapor deposition processes may be used. The form of zinc used may be any form of zinc that will diffuse or incorporate into the metal surface and that will ultimately form a zinc-metal bond, such as a zinc-chromium oxide. For example, in one embodiment, diethyl zinc or dimethyl zinc may be used. In one embodiment, highly reactive diethyl zinc gas (or other zinc gas) can be diluted with an inert gas. The diluted diethyl zinc gas (or other zinc gas) is then brought into contact with the desired metal surface in which diffusion of zinc is desired. It should be appreciated that incorporation of zinc into the metal surface is not limited to any particular chemical or physical mechanism, such as diffusion. In other words, incorporation of a metal atom or compound into the metal surface by diffusion should not be construed as limiting the present invention to incorporation of the metal atom or compound into the metal surface specifically or exclusively by the process of diffusion.

It should be appreciated that the gaseous diethyl-zinc and dimethyl-zinc may be used to manufacture metal objects or products having "depleted" zinc or zinc without the zinc 64 isotope, which can be activated and converted to zinc-65. The latter, zinc-65, is to be minimized in a nuclear power application. Accordingly, it is preferable to generate the finished metal object or product with depleted zinc-64 when it will be used in a nuclear power environment. However, it should be appreciated that finished metal objects or products that will be used in other than nuclear power applications can also be generated with any zinc isotopic composition including natural zinc.

At a step 104, the semi-finished metal object or product is formed into a shape desired for the finished metal object or product. Since the zinc is incorporated into a semi-finished metal object or product, it must be then formed into a shape desired for the finished metal object or product. Accordingly, step 104 is forming the semi-finished metal object or product into the desired shape of the finished metal product. For example, if the finished metal product is a flat metal panel, then whatever starting semi-finished metal object or product is used, such as a metal slab, in this step 104, that metal slab will be formed into the desired shape of the flat metal panel. The step 104 may be performed using any process known in the art for taking a semi-finished metal object or product and shaping it to place it in the shape desired for the finished metal object or product, as is typically done in metal manufacturing processes known by one of skill in the art.

At the step 106, the semi-finished metal object or product having the shape desired for the finished metal object or product is heat-treated. This heat treatment includes heating the semi-finished metal object or product as is typically done in an annealing process used in the standard manufacture of finished metal objects or products. This heat treatment is performed in a controlled environment to promote the formation of a stable zinc-metal oxide layer, such as a zinc-chromium oxide layer, or zinc-mixed metal oxide layer. For example, the controlled environment may include the presence of hydrogen and oxygen so that the incorporated zinc forms a stable zinc-metal oxide layer, such as a zinc-chromium oxide layer, within the top portion of a surface of the semi-finished metal object or product. The creation of this oxide layer provides a stable oxide layer that is more stable than oxide layers created using a finished metal object or product, such as the preconditioning performed during operational chemical exposure after manufacturing. Without being limited by theory, it is believed that by incorporating zinc within a portion of the metal surface before heat-treating, the corresponding zinc-metal oxide layer extends to a greater depth or is more thick, as well as more stable and permanent, compared to any zinc oxide layer formed in-situ, in which case, the depth to which the zinc is incorporated is more shallow.

As described above, it should be appreciated that one or more additional metals may be incorporated into the metal object or product along with the zinc. For example, in one embodiment in which zinc is used to create the corrosion resistant layer, another metal, such as chromium, may be added to the metal object or product in combination with the zinc. In one embodiment, the chromium is incorporated into the metal object or product in the same manner as the incorporation of the zinc. In one embodiment, the chromium is incorporated into the metal object or product at the same time as the incorporation of the zinc. It should be appreciated that any metal may be incorporated into the metal object or product with the zinc to allow for the creation of a tailored metal composition in the top portion of the metal object or product. For example, in those cases in which the metal object or product is deemed to have a deficiency of a given metal species, such metal species can be incorporated into the metal object or product, including into the top portion, along with the metal used to create the corrosion resistant layer. It should be appreciated that more than one metal can be added along with the metal used to create the corrosion resistant layer.

Although the foregoing has been described in the context of manufacturing the metal object or product and the benefits of forming the corrosion resistant layer during such manufacturing, in other embodiments, it is still possible to form a corrosion resistant layer for metal objects or products after manufacturing and even after such metal objects or products have been placed in use or service. In some embodiments, it is possible to form the corrosion resistant layer with the metal object or product in place or in-situ. In these situations, the metal used to form the corrosion resistant layer can be incorporated into the metal object or product in the same manner described above in with respect to FIG. 1. It should be appreciated that additional metals may also be incorporated as described above.

Figure 2:
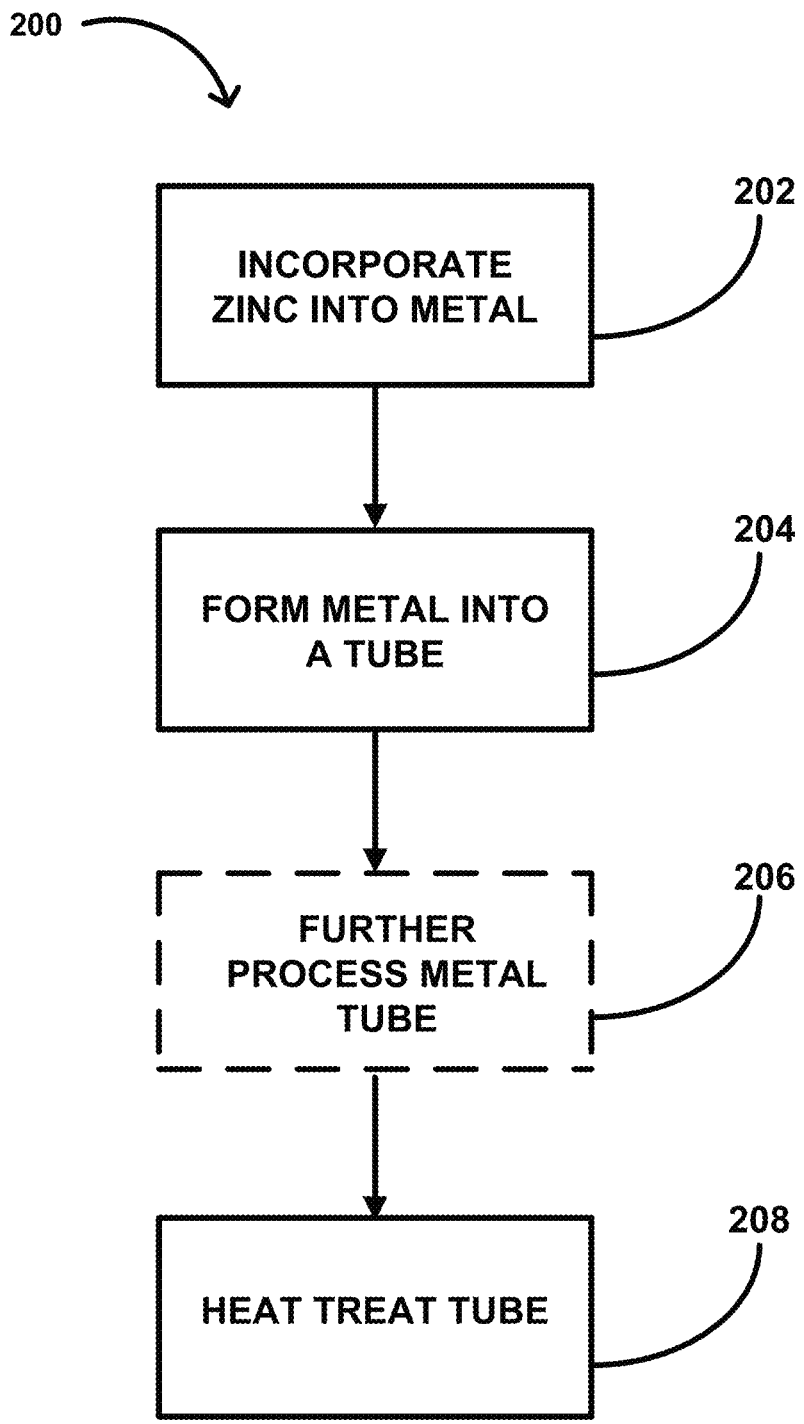
FIG. 2 illustrates a method for manufacturing a metal tube having a corrosion resistant layer according to one embodiment of the present invention.

FIG. 2 illustrates a method for manufacturing a metal tube having a corrosion resistant layer according to one embodiment of the present invention. The method of manufacturing 200 is similar to that shown in FIG. 1, except that the process 200 shown in FIG. 2 is specifically directed to the manufacture of metal tubing as the finished metal object or product.

In a first step 202, zinc is incorporated into at least one surface of the semi-finished metal produce, which in this embodiment is a semi-finished metal product that can be ultimately manufactured into a metal tube, such as a flat strip. The incorporation of the zinc can be performed in the same manner and using any of the same processes described above in connection with FIG. 1. It should be appreciated, however, that in this embodiment, the zinc needs to be incorporated into the top portion of the surface of the semi-finished metal product that will ultimately form the inner surface of the metal tubing.

In a second step 204, the semi-finished metal object or product, such as the flat strip, is formed into a tube (e.g., welded tube). This step is performed as is typically done in the metal manufacturing process as known to one of skill in the art. However, it should be appreciated that depending upon the process used to form the metal tube, in another embodiment, the zinc may not be incorporated into the metal surface until after the metal tube has been formed. In that case, the first step 202 of incorporating the zinc would be done after the second step 204 of forming the metal tube. In this embodiment, the metal tube (e.g. a seamless metal tube) could be formed from a semi-finished metal object or product such as an ingot or bloom or metal billet. Once the metal tube is formed, then the zinc would be incorporated into the inner surface of the metal tube as described above in connection with FIG. 1.

In a next step 206, the metal tube can be optionally (as represented by the dashed lines) further processed. For example, in the case of the metal tube, it can be further processed, as known in the art, by pilgering or through use of a cold-drawing process.

In a next step 208, the metal tube is heat-treated. This process can be performed in the same manner and for the same purpose as that described in connection with FIG. 1.

Figure 3:
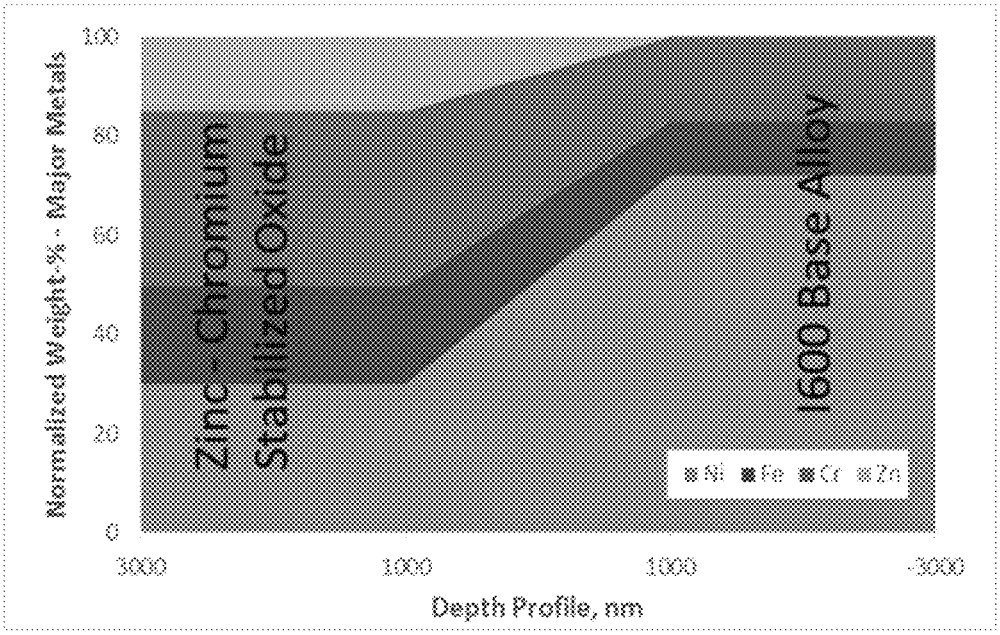
FIG. 3 illustrates the results of theoretical calculations showing the composition of a metal surface as a function of depth for I600 base alloy.
Figure 4:
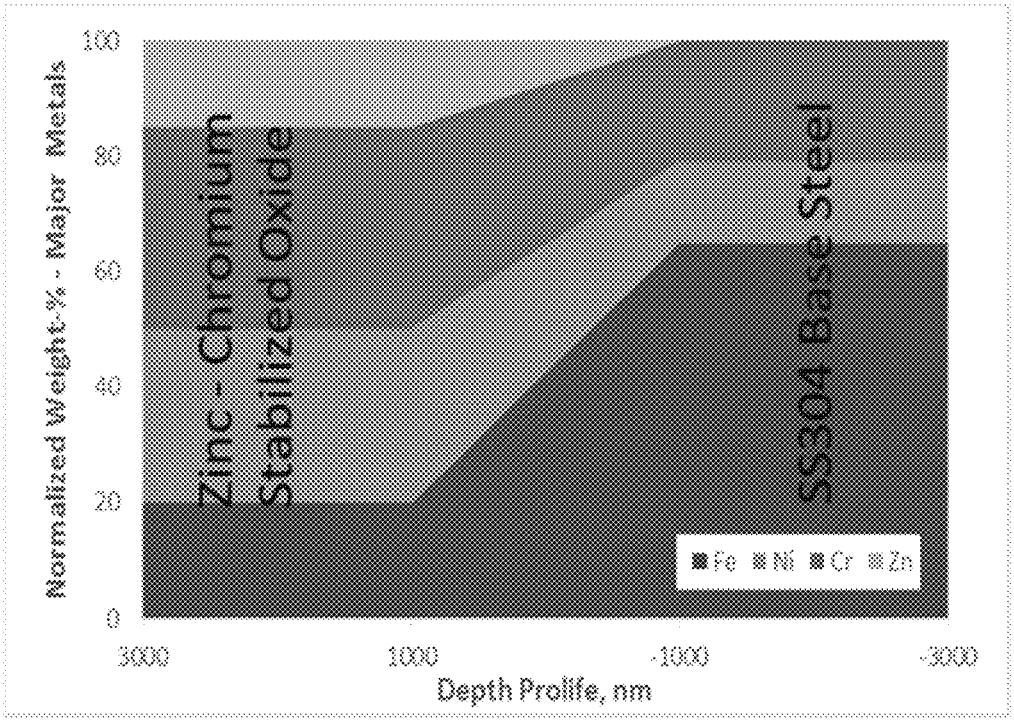
FIG. 4 illustrates the results of theoretical calculations showing the composition of a metal surface as a function of depth for SS304 base steel.

FIG. 3 illustrates theoretical example calculations of the composition of a metal surface as a function of depth for I600 base alloy. FIG. 4 illustrates theoretical example calculations of the composition of a metal surface as a function of depth for SS304 base steel. For clarity, each of these figures illustrates the concentration of various components of the metal from the exposed surface (left side of each graph) to a given depth within the metal (right side of each graph). Specifically, the relative concentrations of nickel, iron, chromium, and zinc are shown individually from bottom to top of each graph, respectively. As shown, the decrease in the amount of zinc (the top component in each graph) is shown from left to right, to a depth at which there is no zinc and the composition of the metal is same as that of the starting semi-finished metal object or product prior to incorporation of zinc. It should be appreciated that FIGS. 3 and 4 illustrate the results of theoretical calculations for these specific metals; however, similar metals would be expected to behave similarly.

Various embodiments of the invention have been described above. However, it should be appreciated that alternative embodiments are possible and that the invention is not limited to the specific embodiments described above.

What is claimed is:

1. A method for creating a metal object having a corrosion resistant layer, comprising:

incorporating zinc within at least one portion of a metal body of a metal object, wherein the metal body comprises an outer surface and an interior, wherein the at least one portion extends from the outer surface of the metal body inwardly toward the interior of the metal body, and wherein the outer surface of the metal body will be exposed during use of the metal object;

forming a corrosion resistant layer within the portion of the metal body.

2. The method of claim 1, wherein the corrosion resistant layer comprises a zinc-metal oxide layer.

3. The method of claim 2, wherein the metal surface comprises chromium and wherein the zinc-metal oxide layer comprises a zinc-chromium oxide layer.

4. The method of claim 1, wherein the metal surface comprises an alloy comprising chromium.

5. The method of claim 1, wherein the metal surface comprises nickel-iron-chromium bearing steel.

6. The method of claim 1, further comprising:

incorporating a second metal into the portion of the metal body.

7. The method of claim 6, wherein the second metal comprises chromium.

8. A method for creating a metal object having a corrosion resistant layer, comprising:

incorporating zinc into at least one portion of a metal body of a metal object extending from an outer surface of the metal body inwardly, thereby avoiding formation of a layer comprising zinc on top of the outer surface of the metal body and wherein the outer surface of the metal body will be exposed during use of the metal object;

forming a corrosion resistant layer within the portion of the metal body.

9. The method of claim 8, wherein the metal surface comprises an alloy comprising chromium and the corrosion resistant layer comprises a zinc-mixed metal oxide.

10. The method of claim 8, wherein the metal surface comprises nickel-iron-chromium bearing steel and the corrosion resistant layer comprises a zinc-mixed metal oxide.

11. The method of claim 8, further comprising:

incorporating a second metal into the portion of the metal body.

12. The method of claim 11, wherein the second metal comprises chromium.

13. A method for creating a finished metal product having a corrosion resistant layer, comprising:

adding zinc into a pre-existing portion of a metal body of a semi-finished metal product, wherein the pre-existing portion extends from and beneath a pre-existing outer metal surface of the metal body, and wherein the pre-existing outer metal surface will be exposed during use of a finished metal product produced from the semi-finished metal product;

forming the semi-finished metal product into a predetermined shape of the finished metal product after said adding; and heat-treating the semi-finished metal product after said forming to form a zinc-metal oxide layer within the portion of the metal body.

14. The method of claim 13, wherein the metal surface comprises chromium and the zinc-metal oxide comprises a zinc-chromium oxide.

15. The method of claim 13, wherein the zinc-metal oxide comprises a zinc-mixed metal oxide.

16. The method of claim 13, further comprising:

incorporating a second metal into the portion of the metal body.

17. A method for creating a metal tube having a corrosion resistant layer integral to an exposed inner surface of the metal tube, comprising:

adding zinc into an existing portion of a metal body of a semi-finished metal product, wherein the existing portion extends from a metal surface of the metal body and into the metal body;

forming a metal tube from the semi-finished metal product before or after said adding, wherein the metal surface is an inner surface of the metal tube that will be exposed during use of the metal tube;

heat-treating the metal tube after said forming to form a zinc-metal oxide layer within the existing portion of the metal tube, wherein the zinc-metal oxide layer extends to the metal surface.

18. The method of claim 17, further comprising:

processing the metal tube after said adding, after said forming, and before said heat-treating by pilgering or using a cold drawing process.

19. The method of claim 17, wherein the metal surface comprises chromium and the zinc-metal oxide comprises a zinc-chromium oxide.

20. The method of claim 17, further comprising:

incorporating a second metal into the metal surface.

21. A method for creating a metal product having a corrosion resistant layer, comprising:

incorporating zinc into a portion of a metal body of a metal object, wherein, prior to said incorporating, the portion has an outer surface that will be exposed during use of a corresponding finished metal product;

processing the metal object into a finished metal product; and forming a corrosion resistant layer integral to the portion, wherein the corrosion resistant layer extends from the outer surface of the portion into the body of the corresponding finished metal product.

* * * * *